US009688371B1

(12) United States Patent
Ruffa

(10) Patent No.: US 9,688,371 B1
(45) Date of Patent: Jun. 27, 2017

(54) VEHICLE BASED VECTOR SENSOR

(71) Applicant: Anthony A Ruffa, Hope Valley, RI (US)

(72) Inventor: Anthony A Ruffa, Hope Valley, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 30 days.

(21) Appl. No.: 14/867,220

(22) Filed: Sep. 28, 2015

(51) Int. Cl.
*H04R 1/44* (2006.01)
*B63G 8/00* (2006.01)

(52) U.S. Cl.
CPC ..... *B63G 8/001* (2013.01); *H04R 1/44* (2013.01); *B63G 2008/002* (2013.01)

(58) Field of Classification Search
None
See application file for complete search history.

(56) References Cited

U.S. PATENT DOCUMENTS 6,046,963 A 4/2000 Glenning
6,697,302 B1 2/2004 Cray
6,972,678 B2 12/2005 Houston
7,054,228 B1 5/2006 Hickling
7,106,658 B1 * 9/2006 Cray ..... G01S 3/805 367/119
7,505,367 B2 3/2009 Abdi
7,536,913 B2 5/2009 Naluai
7,679,999 B2 3/2010 Ruffa
8,085,622 B2 12/2011 Donskoy
8,437,885 B1 * 5/2013 Beazley ..... B63G 8/001 701/2
8,638,956 B2 1/2014 Deng
9,457,900 B1 * 10/2016 Jones ..... B64C 39/02
2003/0078706 A1 * 4/2003 Larsen ..... G01C 21/00 701/21
2003/0117025 A1 * 6/2003 Rouquette ..... G01V 1/201 307/147
2008/0264323 A1 * 10/2008 Gosling ..... B63G 8/08 114/330
2010/0106440 A1 * 4/2010 Richmond ..... G01S 3/74 702/71
2010/0281979 A1 * 11/2010 McConnell ..... G01V 1/181 73/514.28
2012/0057430 A1 * 3/2012 Rouquette ..... G01V 1/189 367/24
2013/0038462 A1 * 2/2013 Abdi ..... H04B 13/02 340/850

(Continued)

*Primary Examiner* — Truc M Do
(74) *Attorney, Agent, or Firm* — James M. Kasischke; Michael P. Stanley

(57) ABSTRACT

A neutrally buoyant underwater vehicle is provided in which a length of the vehicle is up to one tenth the length of a predetermined acoustic wavelength. The vehicle includes an inertial navigation system with an accelerometer capable of measuring velocity in a multi-axis direction. The navigation system is operationally connected to a hydrophone which measures acoustic energy of the wavelength arriving at the underwater vehicle. A processor gathers the data from the accelerometer and the hydrophone to convert the data into usable units. The operation of the vehicle-based components is similar to a vector sensor for frequencies of 250 Hz or lower.

6 Claims, 1 Drawing Sheet

(56) References Cited

U.S. PATENT DOCUMENTS

| | | | | |
|---|---|---|---|---|
| 2013/0312522 | A1* | 11/2013 | Deng | G01H 11/08 73/514.33 |
| 2014/0113828 | A1* | 4/2014 | Gilbert | H01L 39/126 505/100 |
| 2015/0098302 | A1* | 4/2015 | Olivier | G01V 1/38 367/15 |
| 2015/0323558 | A1* | 11/2015 | Cranch | G01D 5/266 356/28.5 |
| 2016/0214696 | A1* | 7/2016 | Soohoo | G05D 1/0208 |
| 2016/0355247 | A1* | 12/2016 | Ibn Seddik | B63G 8/14 |

* cited by examiner

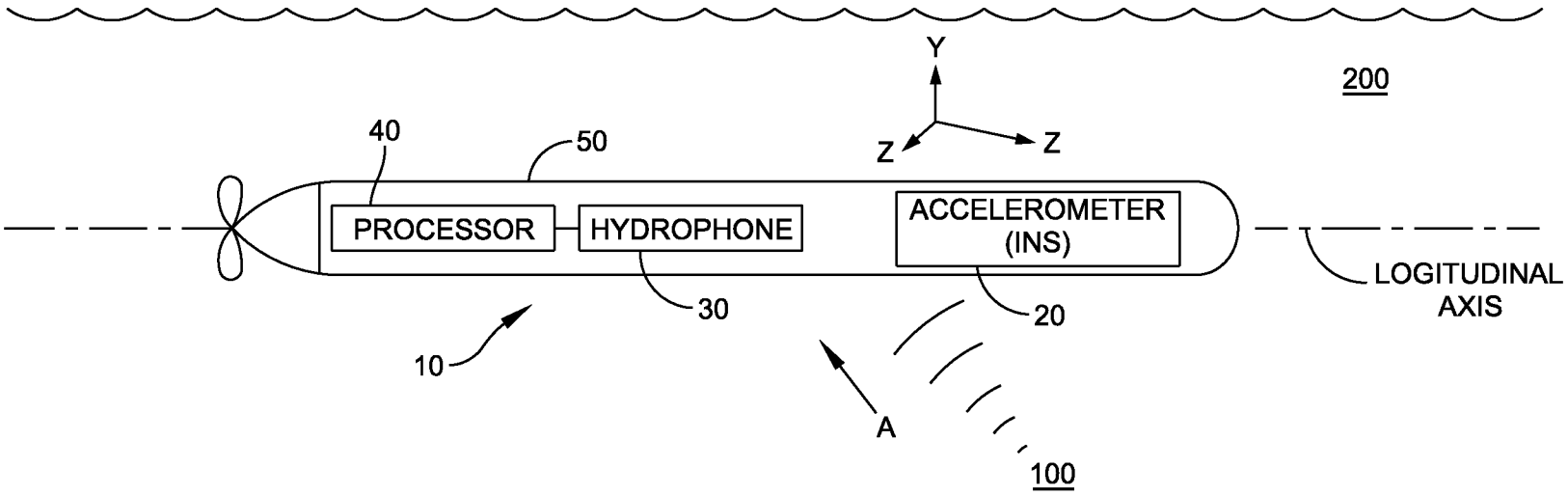
200
LOGITUDINAL AXIS
ACCELEROMETER (INS)
20
100
Z
Y
Z
A
HYDROPHONE
30
50
PROCESSOR
40
10

VEHICLE BASED VECTOR SENSOR

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER PATENT APPLICATIONS

None.

BACKGROUND OF THE INVENTION (1) Field of the Invention

The invention is an unmanned underwater vehicle that can function as an acoustic vector sensor.

(2) Description of the Prior Art

It is known that a propagating acoustic plane wave in water will cause fluid particles to move in an oscillatory motion. A "fluid particle," as the term relates to the present invention, is a small volume of fluid surrounding a point where averaged properties (e.g., velocity, temperature, etc.) can be analyzed with continuum mechanics. An acoustic vector sensor measures the particle motion via an accelerometer and combines the motion measurement with a hydrophone in order to obtain a high degree of directionality in a relatively small package. Based on these advantages, acoustic vector sensors have become an active area of research.

An outgrowth in the research of vector sensor technology is that if an object in water is neutrally buoyant and small compared to a wavelength (if the acoustic wavelength is at least ten times larger than the object's representative length scale); the object will respond as a fluid particle in the sense that an acoustic plane wave will cause the object to move back and forth with the same oscillatory motion induced in the surrounding water.

At low frequencies, unmanned underwater vehicles (UUVs) are typically small in measurement as compared to an acoustic wavelength. For example: at a frequency of 100 Hz in water, the wavelength is fifteen meters. This wavelength is large compared to the diameter of almost all known UUVs and is even large compared to the length of many UUVs. If the UUV is also neutrally buoyant in water; the UUV will assume the same motion as the neighboring fluid particles induced by the acoustic fields propagating in the water in a direction transverse to the UUV axis. Thus, the UUV itself can function as an accelerometer for the purposes of acting as an acoustic vector sensor under these conditions.

In the prior art of sensor technology; Glenning (U.S. Pat. No. 6,046,963) discloses an undersea vehicle incorporating a hull array in a stowed position. Sensors are joined to analysis circuitry within an inner hull. The sensors can be either velocity sensors or pressure sensors operating on piezoelectric, optical or magneto-strictive principles or the like. The hull array is slidably mounted at each side to guide track sets. Each guide track has an outer track and an inner track.

In Cray et al. (U.S. Pat. No. 6,697,302) an underwater acoustic receiver is provided that measures pressure. Acoustic particle acceleration being sensed by each of the accelerometers (which can be converted to acoustic velocity by taking the time derivative) is obtained by taking the average of the acceleration along a given axis. For example: the x-acceleration component (denoted "u" in terms of velocity) is obtained by summing accelerometer outputs and dividing by two. The acceleration components are obtained in a similar manner.

In Houston et al. (U.S. Pat. No. 6,972,678), a schematic depicts a planar waveguide formed on the outer surface of a hull of a vessel. The waveguide comprises an outer dielectric layer, an optional metal coat, an inner dielectric layer and the outer surface of the hull.

In Hickling (U.S. Pat. No. 7,054,228), a method and apparatus for locating and quantifying sound sources using an array of acoustic vector probes is disclosed. The set of sound-intensity vectors measured by the array provides a set of directions to a sound source whose approximate spatial coordinates are determined using a least-squares triangulation formula. The sound intensity vectors also determine sound-power flow from the source.

In Cray et al. (U.S. Pat. No. 7,106,658), a single directional sensor that can be positioned on an underwater or surface vehicle is disclosed. A transponder radiates a coded acoustic signal. The signal is received at the sensor on the vehicle. A sensor processor is also positioned on the vehicle. The sensor processor includes a clock synchronized with a source processor clock. The sensor processor calculates distance between the transponder and the sensor using the one-way time delay from signal transmission and the speed of signal propagation through the environment.

In Abdi (U.S. Pat. No. 7,505,367) vector components of an acoustic field may be measured using devices including, but not limited to, transducers, receivers and vector sensors. Measurements of the scalar components of the acoustic field may be made using devices which include, but are not limited to, pressure sensors, transducers, hydrophones, omni-directional hydrophones, directional hydrophones and/or any other devices that achieve the same or similar functionality. Recovering information from the vector components of the acoustic field is not limited to any particular sensor type; any device capable of measuring a vector component of the acoustic field suffices.

In Naluai et al. (U.S. Pat. No. 7,536,913), a probe is disclosed that can be directly mounted to an external support structure via a central support rod at a desired elevation measurement point and oriented in a desired measurement direction. Combinations of the various signal output of the probe yield accurate measurements of the vector field of the acoustic intensity.

In Ruffa (U.S. Pat. No. 7,679,999) a bow dome acoustic sensor assembly is disclosed that includes a forward-most outer hull portion of the submarine and surface ship—known as the "bow dome". An acoustic panel is mounted on a pressure hull portion via acoustically isolating supports. An after surface of the acoustic panel is provided with optical properties which permit analysis of light from a laser.

Donskey et al. (U.S. Pat. No. 8,085,622) illustrates an ultra low frequency acoustic vector sensor; the acoustic sensor is adapted to measure ultra low frequency liquid particle oscillations when positioned in a body of water. More particularly, the acoustic sensor includes a spherically-shaped housing which has a liquid-tight compartment or horn positioned centrally therein.

Deng (U.S. Pat. No. 8,638,956) illustrates an exemplary buoyant object of an acoustic velocity microphone shown in relation to an acoustic wavelength. The feature size of the buoyant object may be smaller than the wavelength of an acoustic wave. The buoyant object follows the movement of the acoustic particle of the acoustic wave passing thru the buoyant object. In other words, the velocity of the buoyant object is the same as or similar to the particle velocity of the acoustic wave.

Stacey et al. (U.S. Pat. No. 8,385,155) discloses a digital acoustic sensor system comprising an acoustic sensor that is configured to detect an underwater acoustic signal and form an analog signal that is proportional to the underwater acoustic signal. In another embodiment, the acoustic sensor can be an accelerometer configured to sense a change in velocity caused by an underwater acoustic signal. An acoustic vector sensor, such as a hydrophone vector sensor, can be used to measure the direction of the acoustic signal.

The preceding patent references are general approaches for realizing a vector sensor, in some cases not limited to any particular sensor type. The references teach a situation different from an underwater vehicle that can be made neutrally buoyant and is often smaller than an acoustic wavelength. As such, a novel approach would be to use the entire underwater vehicle to emulate an underwater acoustic sensor. Furthermore, the prior art does not teach the use of the accelerometers primarily employed by a UUV for inertial navigation that can also determine acceleration measurements necessary to operate as an acoustic vector sensor.

SUMMARY OF THE INVENTION

It is therefore a general purpose and primary object of the present invention to provide an unmanned underwater vehicle (UUV) in which the vehicle can emulate the operation of an acoustic vector sensor.

To attain the object described, the present invention provides an acoustic vector sensor based on the movement of a neutrally buoyant UUV. A synergistic design that emulates an acoustic vector sensor takes advantage of two characteristics of the UUV. One is that the use of an accelerometer for the inertial navigation system can also be used as the accelerometer component of the vector sensor. The tri-axial accelerometer used for the inertial navigation system of a UUV is typically much more accurate than accelerometers typically used for acoustic sensing. If the UUV uses another form of navigation that does not use an accelerometer, then a separate accelerometer would be used with the hydrophone to perform the acoustic vector function.

The accelerometer of the inertial navigation system can measure the particle acceleration associated with an acoustic wave arriving at an arbitrary incidence angle. When the accelerometer's output signal is combined with an output of a hydrophone positioned within the UUV; the resulting output emulates the operation of a low-frequency acoustic vector sensor.

Because the invention can apply to underwater vehicles that are neutrally buoyant when their length scale is small compared to an acoustic wavelength; the present invention takes advantage of UUV characteristics that already exist to provide a low frequency vector sensor. Also, interference by other internal components has minimal operational impact on the hydrophone or the accelerometer of the inertial navigation system (for the purposes of performing vector sensor measurements) because of diffraction at low frequencies.

A distinct advantage of the present invention is having a portable, low cost and low frequency directional capability by the technically simple but novel act of integrating a hydrophone with the accelerometer capabilities of the inertial navigation system of a UUV.

BRIEF DESCRIPTION OF THE DRAWINGS

Other objects, features and advantages of the present invention will become apparent upon reference to the following description of the preferred embodiments and to the drawing, wherein the FIGURE depicts a schematic of the underwater vehicle of the present invention with use of an accelerometer of the inertial navigation system and the hydrophone acting as a vector acoustic sensor.

DETAILED DESCRIPTION OF THE INVENTION

The present invention can apply to underwater vehicles that are neutrally buoyant and when their length is less than art acoustic wavelength. In the present invention shown in the FIGURE, a neutrally buoyant UUV 10 (for example: having a diameter of twenty-four inches) can effectively sense acoustic energy 100 in an ocean environment 200 with the energy arriving at a direction "A" (broadside to a longitudinal axis of the UUV). In the operational example using the schematic of the FIGURE; the acoustic energy 100 would have wavelengths of 20 feet, or roughly 6 meters.

In the FIGURE, the UUV 10 includes an inertial navigation system with an accelerometer 20 capable of measuring velocity in an "x-y-z" direction (as shown by the axis'). The accelerometer 20 is operationally connected to or integrated with a hydrophone 30 on which the hydrophone measures the acoustic energy 100 arriving at the UUV 10 in direction "A". A processor 40 gathers the data from the accelerometer 20 of the navigation system and the hydrophone 30 to transform the data into usable units of measurement.

The hydrophone 30 does not have to be co-located with the accelerometer 20 and the accelerometer does not have to be part of the inertial navigation system. The separate accelerometer 20 and the hydrophone 30 can be located anywhere in the vehicle, since the vehicle dimensions are small compared to an acoustic wavelength.

The UUV 10 is neutrally buoyant in that the vehicle has the same density as seawater. Because the density is the same, the acoustic characteristics of the UUV 10 will be the same when its characteristic diameter is small compared to an acoustic wavelength. Transmission of sound thru a shell 50 (or material layer) of the UUV 10 is not hindered at low frequencies (i.e., when the shell or layer thickness is small compared to an acoustic wavelength); thereby, making measurement by a hydrophone practical. If there is any hindrance by the shell 50, the effect would be almost non-existant on the operation of the hydrophone 30.

The math supporting the operating scenario of the FIGURE is as follows. The neutrally buoyant UUV 10 should be a tenth of a wavelength or less to act as a fluid particle. If its diameter is 24 inches, the wavelength A should be at least $24\times10=240$ inches, or 20 feet, or 6.096 m. The frequency is $f=c/A=1500/6.096=246$ Hz (or approximately 250 Hz)

In other words, the UUV 10 could effectively become a vector sensor for frequencies of 250 Hz or lower, because the UUV would move with the fluid particle—at least for plane waves propagating in directions transverse to the UUV. Using this approach to sense acoustic energy propagating along the UUV would only be valid at lower frequencies because of a longer length (relative to a diameter).

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A vector sensor sized to a predetermined acoustic wavelength, said sensor comprising:

an unmanned neutrally buoyant underwater vehicle with an interior space in which a length of said underwater vehicle is equal to one tenth of the predetermined acoustic wavelength;

an inertial navigation system for navigating said underwater vehicle, said navigation system including an accelerometer positioned within the interior space of said underwater vehicle with said accelerometer capable of measuring velocity in a triaxial direction; and a hydrophone positioned within the interior space of said underwater vehicle and operationally connected to said accelerometer wherein said hydrophone is capable of sensing acoustic energy of the predetermined acoustic wavelength in an ocean environment when the acoustic energy arrives broadside to a longitudinal axis of said underwater vehicle.

2. The vector sensor in accordance with claim 1 wherein said underwater vehicle has a diameter of twenty-four inches.

3. The vector sensor in accordance with claim 1 wherein the length of said underwater vehicle is less than one tenth of the predetermined acoustic wavelength.

4. A vector sensor sized to a predetermined acoustic wavelength, said sensor comprising:

an unmanned neutrally buoyant underwater vehicle with an interior space in which a length of said underwater vehicle is equal to one tenth of the predetermined acoustic wavelength;

an accelerometer positioned within the interior space of said underwater vehicle with said accelerometer capable of measuring velocity in a triaxial direction; and a hydrophone positioned within the interior space of said underwater vehicle and operationally connected to said accelerometer wherein said hydrophone is capable of sensing acoustic energy of the predetermined acoustic wavelength in an ocean environment when the acoustic energy arrives broadside to a longitudinal axis of said underwater vehicle.

5. The vector sensor in accordance with claim 4 wherein said underwater vehicle has a diameter of twenty-four inches.

6. The vector sensor in accordance with claim 4 wherein the length of said underwater vehicle is less than one tenth of the predetermined acoustic wavelength.

* * * * *